US005768719A

United States Patent [19]

Harvey

[11] Patent Number: 5,768,719

[45] Date of Patent: Jun. 23, 1998

[54] APPARATUS AND METHODS FOR UNCLOGGING A TOILET

[76] Inventor: Neil Harvey, 21 Ellsmere St., Worcester, Mass. 01604

[21] Appl. No.: 897,071

[22] Filed: Jul. 18, 1997

Related U.S. Application Data

[63] Continuation of Ser. No. 523,133, Sep. 5, 1995, abandoned.

[51] Int. Cl.[6] ..... E03D 9/00

[52] U.S. Cl. ..... 4/255.01

[58] Field of Search ..... 4/255.01–255.04, 4/255.06, 255.09, 242.1, 253, 300.3

[56] References Cited

U.S. PATENT DOCUMENTS

| | | | |
|---|---|---|---|
| 271,357 | 1/1883 | Pike | 4/253 X |
| 716,090 | 12/1902 | Nyberg | 4/255.03 |
| 747,089 | 12/1903 | Schalt | 4/255.03 |

*Primary Examiner*—Charles E. Phillips
*Attorney, Agent, or Firm*—Curtis A. Vock

[57] ABSTRACT

A toilet seat includes a substantially rigid lid coupled to a pliant top. The seat seals against the rim of the standard toilet bowl and forms a pressure-adjustable cavity with the bowl and the surface of the water. Once sealed, the seat is pumped to inject air into the cavity, thereby increasing the pressure in the cavity to cause a flush operation. The lid and top each have one way pressure valves permitting air to flow into the cavity as the top is pumped. In another embodiment, the toilet has a standard toilet seat and is connected to a vacuum source via a selectively operable valve. The valve is selectively operable between an open state and a closed state, the open state creating a fluid communication path between the vacuum source and the void volume, the closed state providing a substantially airtight seal between the void volume and the vacuum source. A flapper controls the fluid communication between the void volume and the sewer drain, and is operable between a first state, wherein the flapper is closed to provide a substantially airtight seal between the void volume and the sewer drain, and a second state, wherein the flapper is open and the void volume is in fluid communication with the sewer drain. In operation, the flushable water is sucked into the void volume when the valve is in the open state and the flapper valve is in the first state, and the flushable water within the void volume passes into the sewer drain when the valve is in the closed state and the flapper valve is in the second state.

8 Claims, 4 Drawing Sheets

APPARATUS AND METHODS FOR UNCLOGGING A TOILET

This is a continuation of U.S. patent application Ser. No. 08/573,133 filed Sep. 5, 1995, now abandoned.

BACKGROUND

Modern toilets are generally efficient, both at the home and at commercial and industrial sites. Typically, a handle or foot pedal is selectively operable by a user of the toilet to cause a flush operation, which flushes the waste, water and paper within the toilet bowl down into the sewage system.

However, the methods for unclogging toilets are neither modern, efficient or desirable. For example, once a toilet is clogged, there is little that can be done except for the use of the toilet "plunger." To be practical, the plunger must reside adjacent to the toilet, which is unsightly and which clutters valuable floor space.

Other, equally undesirable solutions to unclogging toilets include (i) pouring water from a bucket into the toilet bowl, and (ii) waiting for the waste and paper to "soften up" so that the pressure within the bowl eventually flushes through the drainage system.

It is, accordingly, an object of the invention to provide apparatus for flushing toilets in an efficient and compact manner.

Still another object of the invention is to provide apparatus for unclogging toilets which overcomes the problems described above.

These and other objects will become apparent in the description which follows.

SUMMARY OF THE INVENTION

The invention provides, in one aspect, a toilet seat for unclogging a toilet selectively. This toilet is of the type which includes a bowl with a rim for containing flushable water therein. A substantially rigid lid is sealable to the bowl and on the rim such that the lid, bowl and water surface form a pressure-adjustable cavity within the bowl once the lid is sealed to the rim. The lid includes a first one-way valve extending through the lid, so that air injected through the first one-way valve and into the pressure-adjustable cavity raises the pressure of the pressure-adjustable cavity to a level which causes the water to flush and unclog the toilet.

In another aspect, the toilet seat assembly can include a lid top having a substantially pliant outer surface with a second one-way valve extending therethrough. This outer surface and the lid form a pump pressure cavity therebetween which increases in pressure when a user presses on the outer surface, thereby injecting air into the pressure-adjustable cavity through the first and second one-way valves. The second one-way valve specifically provides a passageway for air to replenish the pump pressure cavity.

In still another aspect, the outer surface includes structure for pliantly biasing the outer surface to a substantially uncompressed state, thereby sucking air into the pump pressure cavity after a user ceases to press the outer surface. Accordingly, the pump pressure cavity reaches a pressure equilibrium with the atmosphere external to the outer surface when the outer surface reaches the uncompressed state.

The invention also provides improvements in a toilet of the type having a bowl for containing flushable water therein. The improvement of this aspect includes a pump-actuated toilet seat assembly for undogging the toilet selectively. The toilet seat assembly has a substantially rigid lid for covering the bowl. As above, this lid is sealable to the rim and has a first one-way valve extending therethrough. In combination, the lid, bowl and water surface form a pressure-adjustable cavity within the bowl once the lid is sealed to the rim. The improvement of this aspect also includes a lid top with a substantially pliant outer surface having a second one-way valve extending therethrough. This outer surface and the lid form a pump pressure cavity therebetween which increases in pressure when a user presses on the outer surface. In this manner, air is injected from the pump pressure cavity through the first one-way valve and into the pressure-adjustable cavity, raising the pressure of the pressure-adjustable cavity to a level which causes the water to flush and unclog the toilet.

In still another aspect, the outer surface includes means for pliantly biasing the outer surface to a substantially uncompressed state, thereby sucking air into the pump pressure cavity after a user ceases to press the outer surface. In this aspect, the pump pressure cavity reaches substantial pressure equilibrium with the atmosphere external to the outer surface when the outer surface reaches the uncompressed state, as the second one-way valve provides a passageway for air to replenish the pump pressure cavity.

The invention also provides improvements to a toilet of the type having a bowl, for containing flushable water therein, and having a void volume, for passing water through to a sewer drain in a flush operation. In this aspect, a valve connects the void volume to a vacuum chamber. The valve is selectively operable between an open state and a closed state, where the open state creates a fluid communication path between the vacuum source and the void volume, and where the closed state provides a substantially airtight seal between the void volume and the vacuum source. A flapper controls the fluid communication between the void volume and the sewer drain, and is operable between a first state, where the flapper is closed to provide a substantially airtight seal between the void volume and the sewer drain, and a second state, where the flapper is open and the void volume is in fluid communication with the sewer drain. According to this aspect, the flushable water in the bowl is sucked into the void volume when the valve is in the open state and the flapper is in the first state, and the flushable water within the void volume passes into the sewer drain when the valve is in the closed state and the flapper is in the second state.

In another aspect, the valve includes control electronics—which preferably includes a pressure sensor known to those skilled in the art—for detecting when the flushable water enters the void volume. Accordingly, the valve automatically returns to the closed state once the control electronics detects the flushable water within the void volume.

In still another aspect, a user-operated activation switch is connected to the valve and is responsive to the switch by operating in the open state. In another aspect, the flapper of the invention can include a flow preventor.

The flapper of the invention can include a spring which holds the flapper in the first state while the void volume is substantially free of water. The spring releases the flapper to the second state when the flushable water applies a force on the flapper. The flapper can additionally include a flapper controller for detecting when the flushable water enters the void volume, and for commanding the flapper to the second state once it detects the flushable water within the void volume. By way of example, the flapper controller can include a pressure sensor.

In yet another aspect, the invention includes a vacuum source that is connected to the void volume via the valve means. The vacuum source operating to reduce the pressure within the void volume when the valve means is in the open state.

The invention is next described further in connection with preferred embodiments, and it will become apparent that various additions, subtractions, and modifications can be made by those skilled in the art without departing from the scope of the invention.

BRIEF DESCRIPTION OF THE DRAWINGS

A more complete understanding of the invention may be obtained by reference to the drawings, in which.

DETAILED DESCRIPTION OF THE DRAWINGS

Figure 1:
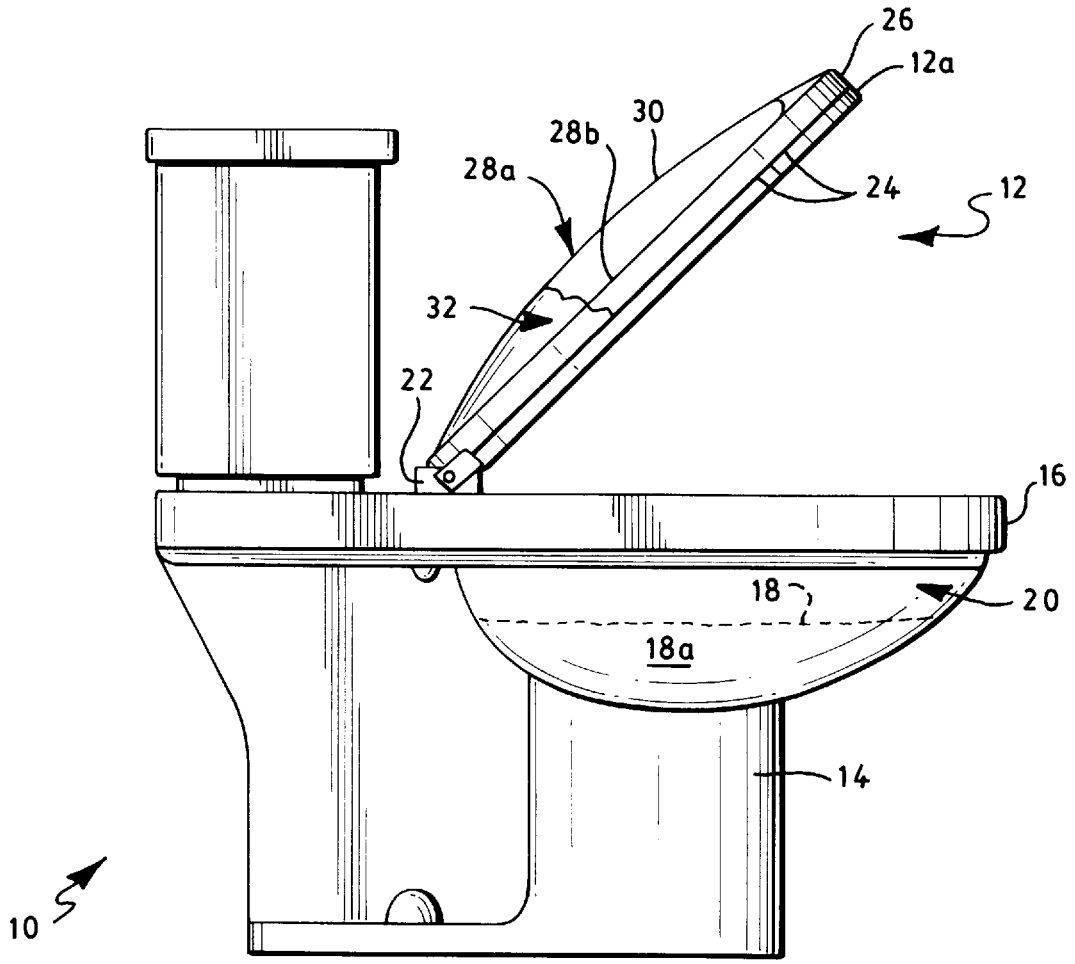
FIG. 1 shows a toilet, shown partially transparent for illustrative purposes, and including a toilet lid, partially cut-away, constructed according to the invention.

FIG. 1 illustrates a toilet 10 that includes a toilet seat assembly 12 constructed according to the invention. Generally, and other than the seat assembly 12, the toilet 10 is like the toilets in the prior art. Specifically, the toilet 10 includes a bowl 14 that has a rim 16 that is higher than the surface of the water 18 within the bowl 14. The water 18*a* within the bowl 14 is used to flush waste and other products down into the sewer system.

Briefly, the seat assembly 12 of the invention includes a seat 12*a* and is sealable on the rim 16 so that a controlled air volume 20 is formed between the water surface 18, bowl 14 and the seat assembly 12. In a preferred embodiment, a hinge 22 connects the seat assembly 12 to the bowl 14 so that the seat 12*a* is moveable between an open and operable position, where a user can use the toilet 10 in a normal manner, and a closed position, where the seat assembly 12 is down and adjacent to the rim 16.

Figure 1B:
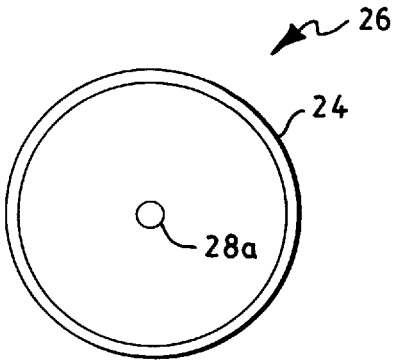
FIG. 1B shows the substantially rigid lid of the seat of FIG. 1.

Once in the closed position, the seat assembly 12 is sealed onto the rim 16 selectively. FIG. 1A illustrates this position. That is, the seat assembly 12 generally rests on top of the rim 16 when closed. However, by pressing the seat assembly 12 downwards, shown illustratively with an arrow 22, the seal 24 on the seat assembly 12 seals against the surface of the rim 16, forming a substantially airtight seal to seal the air volume 20 pressurewise.

The seat assembly 12 includes a substantially rigid lid 26 to provide support for the seal 24 and other parts of the seat assembly 12. The lid 26 is shaped substantially like a disc and includes a one-way valve 28*a*, known to those skilled in the art, extending therethrough. FIG. 1B shows the lid 26, the seal 24 and the valve 28*a* in a top view. The one-way valve 28*a* permits air to pass through the lid 26 in the direction of the arrow 22, FIG. 1A, but does not permit air to pass through the lid 26 in the reverse direction.

Accordingly, when in the closed position shown in FIG. 1A, the lid 26 and seal 24 collectively seal the seat assembly 12 against the rim 16 except for the passageway through the one-way valve 28*a*. Suitable materials for the lid 26 include fiberglass, plastic and composite materials, which are durable and selectively rigid, depending upon material thickness.

Figure 1C:
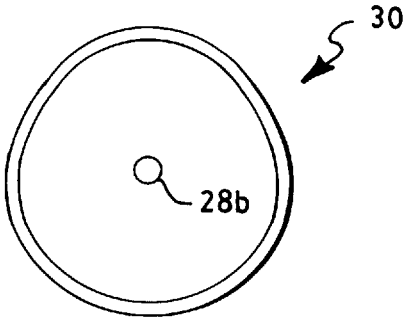
FIG. 1C shows the substantially pliant top of the seat of FIG. 1.
Figure 1A:
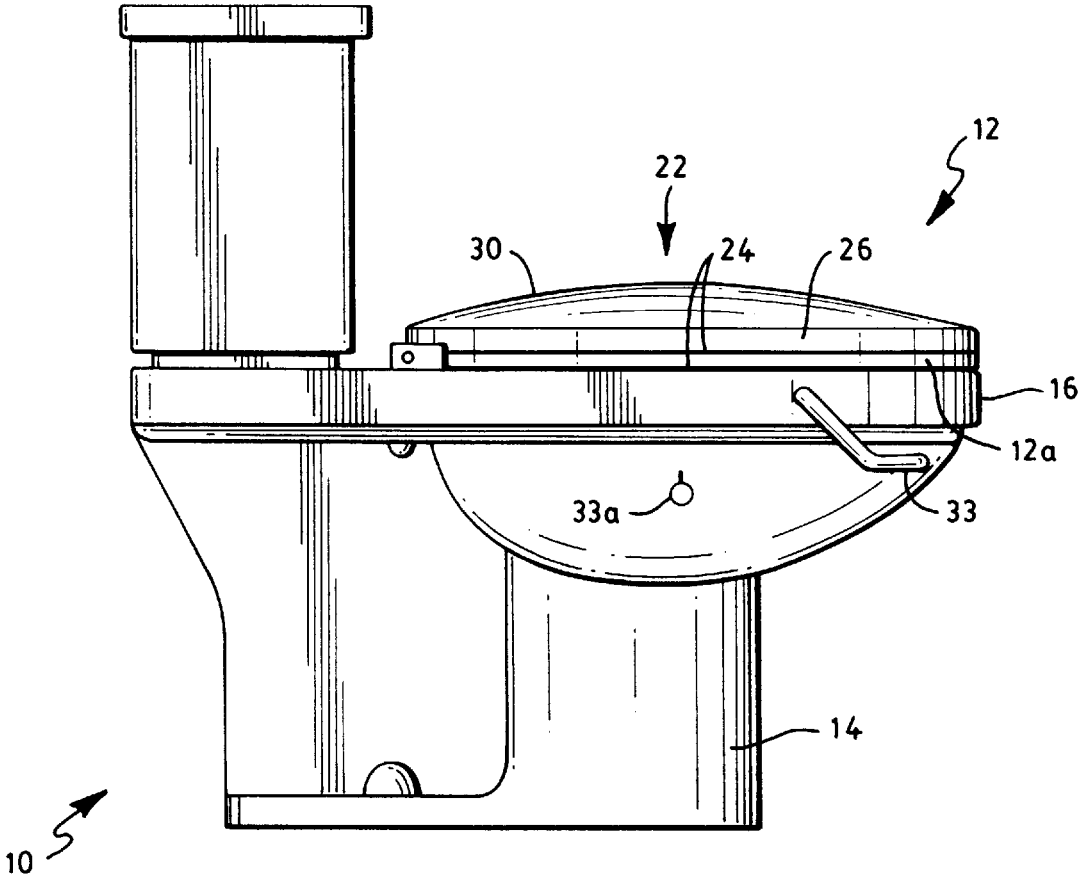
FIG. 1A shows the toilet and seat of FIG. 1 where the seat is in a closed position.

A compliant lid top 30 covers the lid 26 and has a one-way valve 28*b* extending therethrough, such as shown in the top view of FIG. 1C. The one-way valve 28*b* permits air to be injected from outside the lid top 30 through the lid top 30 and into the compression cavity 32 formed between the lid top 20 and the lid 26.

Figure 1D:
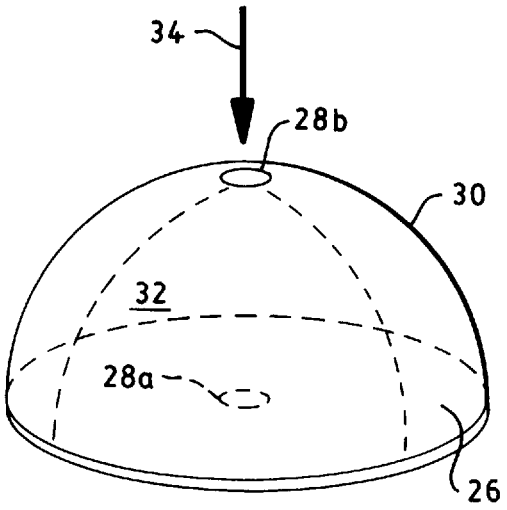
FIGS. 1D and 1E illustrate a pumping action of the seat of FIG. 1, in accord with the invention.
Figure 1E:
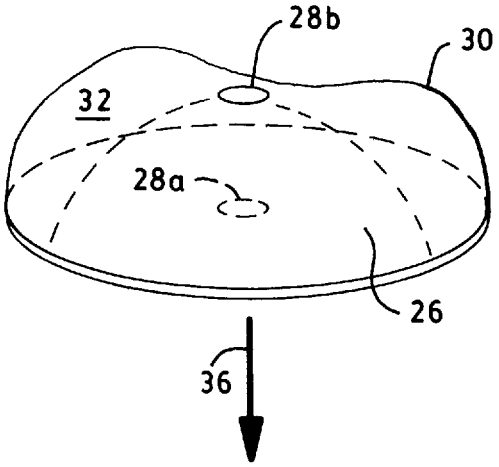

FIGS. 1D–1E illustrate the operation of the cavity 32 in accord with the invention. For illustration purposes, the lid 26 and top 30 are shown transparently in these figures. When a user presses downwards onto the seat assembly 12, such as in a motion shown by the arrow 34, the force on the compliant top 30 compresses the air within the cavity 32 such that the cavity 32 increases in pressure temporarily. This increased pressure forces air 36 out of the cavity 32 and through the one-way valve 28*a*. Because the seat assembly 12 is pressurewise sealed onto the rim 16, the volume 20 is substantially airtight and the pressure within the volume 20 increases as air from the cavity 32 enters the volume 20. FIG. 1E shows a partially compressed cavity 32 caused by an application of force onto the top 30.

When the user stops pressing the top 30, the top 30 expands towards its natural and uncompressed state, such as shown in FIG. 1D. One suitable material for the top 30 is rubber, which has a natural tendency to resist shaping by returning to its predetermined shape. As the top 30 expands from its compressed state, shown in FIG. 1E, to its uncompressed state, shown in FIG. 1D, air is sucked through the one-way valve 28*b* and into the cavity 32 to replenish the air therein. When a user presses the top 30 again, the cycle is repeated with the net effect that the pressure within the volume 20 increases with each pressing. The volume 20 thus operates as a pressure-adjustable cavity which increases in pressure by pumping the top 30.

When the pressure within the volume 20 is "pumped up" to a sufficient pressure, such as described above, the toilet will undergo an flushing operation. Therefore, in accord with the invention, a user can unclog the toilet 12 by successively pressing the top 30. This removes, for example, the need for any plunger at the toilet site.

The toilet seat assembly 12 of the invention can include a latch 33, shown in FIG. 1A. Because the pressure within the volume 20 increases during the pumping action, a force will be generated against the seat assembly 12 and in a direction substantially opposite to the arrow 22. Thus, the increased pressure within the volume 20 sill tend to un-seal the seat assembly 12 against the rim 16. Accordingly, the latch 33 can be used to rigidly interconnect with the bowl 14 so as to resist the pressure forces within the volume 20. In one configuration, the latch 33 is arranged to hook around the surface of the bowl 14, such as shown in FIG. 1A. Alternatively, the bowl 14 can include a mating hook 33*a* which provides a mating structure for interconnecting with the latch 33.

FIGS. 1–1E are illustrative. Those skilled in the art should appreciate that portions of the toilet 10 and seat assembly 12 of these figures are shown in a transparent manner for ease of illustration and understanding.

Figure 2A:
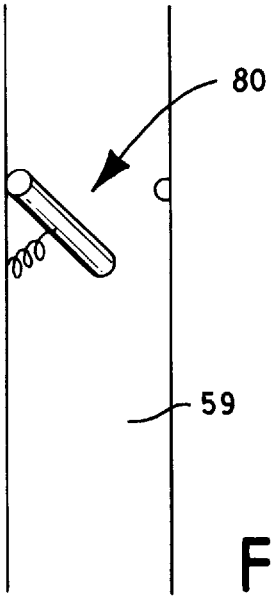
FIG. 2A illustrates a flapper valve constructed according to the invention.
Figure 2:
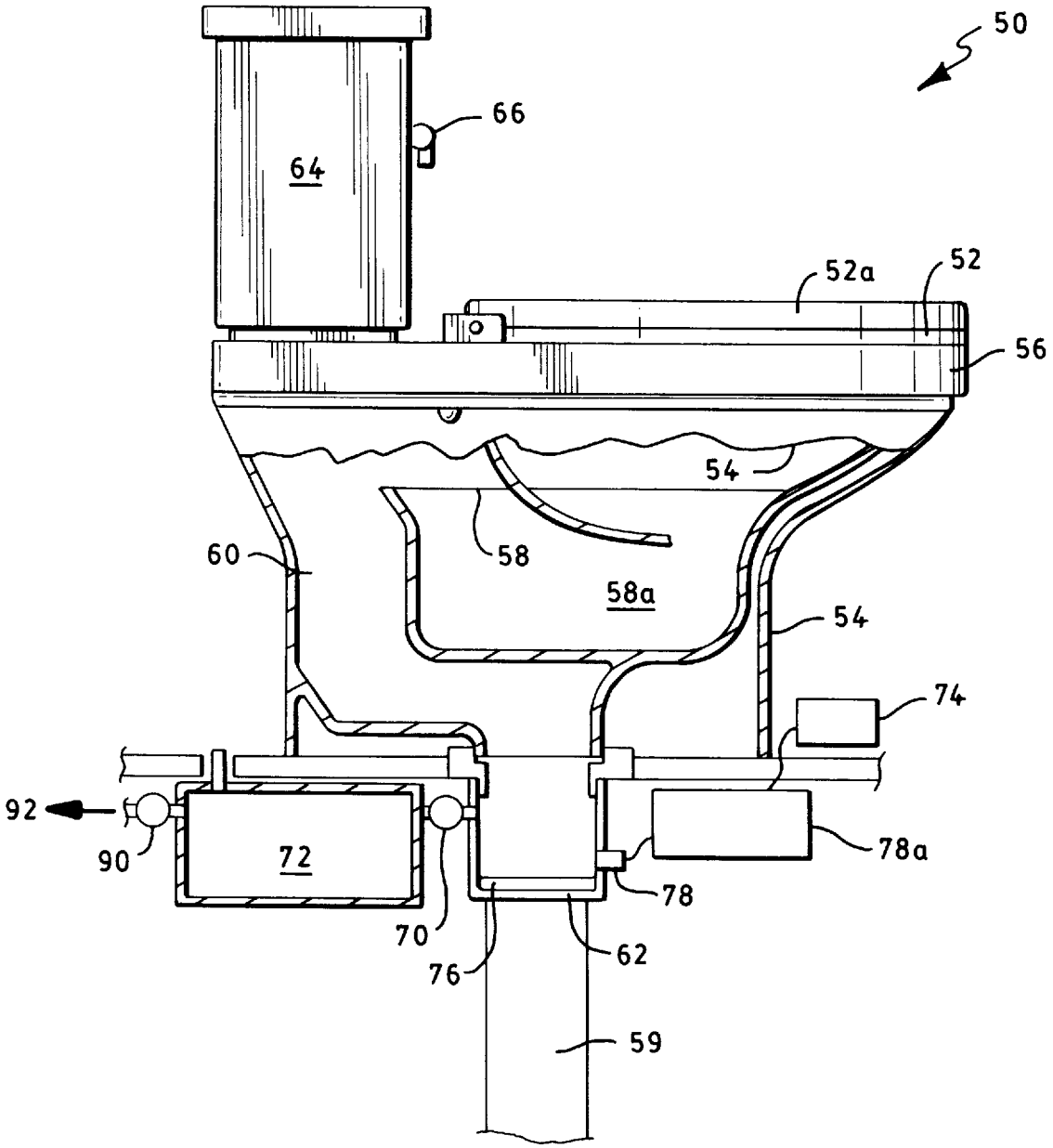
FIG. 2 illustrates a toilet system, partially cut-away, that is constructed according to the invention.

FIG. 2 shows another embodiment of the invention for unclogging toilets. The toilet 50 is partially cut-away, shown by outline 54, for illustrative purposes and ease of understanding the invention.

With further reference to FIG. 2, the toilet 50 includes a standard toilet seat 52 and lid 52*a* that are known in the prior art. The toilet 50 includes a bowl 54 that has a rim 56 which is higher than the surface of the water 58 within the bowl 54. The water 58*a* is used to flush waste and other products down into sewer drain 59 and into the sewer system.

The toilet 50 includes a void volume 60. During a flush operation, the water 58*a* is flushed up into the void volume and then down through the flapper valve 62 and drain 59. The water 58*a* is replenished within the bowl 54 from the water tank 64 on the back of the toilet 50. This flush operation normally occurs by operation of the handle 66, such as commonly known in the art. However, when the toilet 50 is clogged, a flush operation by the handle 66 may not be sufficient to unclog the bowl 54; and over-flowing can occur.

Therefore, in accord with the invention, the toilet 50 includes a first valve 70 that is connected to a vacuum chamber 72, which maintains a pressure of less than about 29.92 Hg. The valve 70 is selectively operable by pressing the switch 74 such that, when the switch 74 is pressed, the valve 70 opens to create a fluid communication path between the chamber 72 and the volume 60. When the valve 70 is closed, it provides an airtight seal between the chamber 72 and the volume 60.

The flapper valve 62 is shown closed within FIG. 2. In this closed state, the flapper valve, which preferably includes a seal 76, provides a substantially airtight seal between the drain 59 and the volume 60. When the valve 62 is in the open state, such as shown in FIG. 2A, the void volume 60 and the drain 59 are in fluid communication with one another, and the water 58*a* from a flush operation can be flushed through the volume 60 and drain 59 unimpeded.

In operation, a user activates the switch 74 to unclog the toilet 50. Once activated, valve 70 is opened and air within the volume 60 is sucked into the vacuum chamber 72, creating a negative pressure (pressure less than standard atmosphere) within the volume 60. The flapper valve 62 is in a closed state during this process, as shown in FIG. 2, so that air and other fluids are not sucked up through the drain 59 and into the volume 60.

The negative pressure created within the void volume 60 tends to force the water 58*a* into the void volume 60. When the negative pressure is sufficient, the force will exceed the clogging forces within the bowl 54 and a flushing operation will commence. This operation will increase the pressure within the volume 60, which is detected by a pressure vacuum sensor 78, known to those skilled in the art. Once detected, the control electronics 78*a* command the valve 70 to close, thus sealing the volume 60 from the vacuum chamber 72. At the same time, the flapper valve is opened so that waste and water 58*a* can exit the volume 60 and enter the drain 59 and sewer system.

One suitable flapper valve 80 according to the invention is shown in more detail in FIG. 2A. A spring 82 biases the valve 80 to a closed position during normal operation. Once the air within the volume 60 (FIG. 2) is evacuated by the chamber 72, the negative pressure within the volume 60 tends to further keep the valve 80 in the closed position, such as shown in FIG. 2. However, once the waste water from the bowl 54 enters the volume 60, the waste water falls onto the flapper valve 72 of FIG. 1 and forces the valve 72 open. Accordingly, and with further reference to FIG. 2A, the spring 82 has sufficient force to nominally bias the flapper valve 80 into a closed position, but has insufficient force to withstand the force of water during a flush operation, thereby not impeding the normal flow of water through the toilet 50 and into the drainage system.

Those skilled in the art will appreciate that other methods for opening and closing the flapper valve fall within the scope of the invention. For example, the control electronics 78*a* can be connected to the flapper valve with an actuating mechanism, such as a linear actuator known to those skilled in the art, to open and close the flapper valve 72 electronically.

After a flush operation, the toilet 50 is preferably recharged and water is refilled within the bowl 54. To recharge, the vacuum chamber 72 is re-evacuated to the desired negative pressure by opening a second valve 90 that is connected to a vacuum pump or other vacuum source 92. The valve 70 is closed during this recharging process so that air is not withdrawn from the volume 60. Once recharged, the toilet 50 is ready for a next flush or unclog cycle.

The invention thus provides advantages over the prior art. First, it provides methods for unclogging toilets in a sanitary and efficient manner, as compared to the prior art. Secondly, existing toilets are easily upgraded to incorporate the features of the invention. For example, the toilet seat described in connection with FIGS. 1–1E can readily replace existing toilet seats provided the seal 24 is configured to seal against the rim of the designated toilet. Third, the toilet of FIGS. 2–2A is especially adapted to commercial and industrial settings since a common vacuum source can service all toilets at that location. Further, those skilled in the art can appreciate that the flushing operations described in connection with FIGS. 2–2A can occur during normal flush operations too, thereby assisting the normal flush operation or even controlling it. For example, fewer toilets will become dogged in the first place if the flushing operation is vacuum assisted, such as provided for with the invention.

Those skilled in the art should appreciate that changes can be made within the description above without departing from the scope of the invention. For example, it should be apparent that the seat 12 of FIGS. 1–1A can operate without the outer pliant lid top 30. In such a configuration, air can be injected directly through the one-way valve 28*a*, FIG. 1B, to increase the pressure within the pressure-adjustable cavity 30 selectively. Alternatively, the lid 26 can be made from a pliant material—similar to the top 30—so that a user can simply press the lid 26 directly to increase the pressure within the volume 30. In this alternative embodiment, the one-way valve 28*a* is not required, since successive pumping actions are not possible. Nevertheless, a single pump action such as described in this alternative embodiment can be sufficient to unclog toilets, in accord with the invention.

The invention thus attains the objects set forth above, among those apparent from preceding description. Since certain changes may be made in the above apparatus and methods without departing from the scope of the invention, it is intended that all matter contained in the above description or shown in the accompanying drawing be interpreted as illustrative and not in a limiting sense.

It is also to be understood that the following claims are to cover all generic and specific features of the invention described herein, and all statements of the scope of the invention which, as a matter of language, might be said to fall there between.

Having described the invention, what is claimed as new and secured by Letters Patent is:

1. Apparatus for unclogging a toilet selectively, the toilet being of the type having a bowl for containing flushable water therein, the bowl having a rim that is higher than the surface of the water within the bowl, comprising:

a substantially rigid lid for covering the bowl, the lid having a first one-way valve extending therethrough, the lid bowl and water surface forming a pressure-adjustable cavity within the bowl once the lid covers the bowl, and a compliant lid top substantially covering said lid and having a substantially pliant outer surface with a second one-way valve extending therethrough, the lid top and the lid forming a pump pressure cavity therebetween which increases in pressure when a user presses on the outer surface, thereby injecting air into the pressure-adjustable cavity, the second one-way valve providing a passageway for air to replenish the pump pressure cavity, wherein air injected through the first one-way valve and into the pressure-adjustable cavity selectively raises the pressure of the pressure-adjustable cavity to a level which causes the water to flush and unclog the toilet.

2. Apparatus according to claim 1, further comprising a hinge for moving the lid between open and closed positions.

3. Apparatus according to claim 1, wherein the lid top comprises means for pliantly biasing the outer surface to a substantially uncompressed state, thereby sucking air through the second one-way valve and into the pump pressure cavity after a user ceases to press the outer surface, and wherein the pump pressure cavity reaches substantial pressure equilibrium with the atmosphere external to the outer surface when the outer surface reaches the uncompressed state.

4. Apparatus according to claim 1, further comprising a toilet seat constructed and arranged with the lid and the lid top for supporting a user of the toilet.

5. Apparatus according to claim 4, further comprising one or more seals constructed and arranged with the seat so as to control air volume within the pressure-adjustable cavity.

6. Apparatus according to claim 4, further comprising a hinge for moving the seat between open and closed positions.

7. In a toilet of the type having a bowl for containing flushable water therein, the bowl having a rim that is higher than the surface of the water within the bowl, the improvement comprising a pump-actuated seat assembly for unclogging the toilet selectively, the seat assembly having (i) a substantially rigid lid for covering the bowl, the lid being sealable with the rim and having a first one-way valve extending therethrough, the lid bowl and water surface forming a pressure-adjustable cavity within the bowl once the lid is sealed to the rim, and (ii) a compliant lid top substantially covering said lid and having a substantially pliant outer surface with a second one-way valve extending therethrough, the lid top and the lid forming a pump pressure cavity therebetween which increases in pressure when a user presses on the outer surface, thereby injecting air from the pump pressure cavity through the first one-way valve and into the pressure-adjustable cavity, and raising the pressure of the pressure-adjustable cavity to a level which causes the water to flush and unclog the toilet.

8. In a toilet according to claim 7, the further improvement wherein the lid top comprises means for pliantly biasing the outer surface to a substantially uncompressed state, thereby sucking air into the pump pressure cavity after a user ceases to press the outer surface, and wherein the pump pressure cavity reaches substantial pressure equilibrium with the atmosphere external to the outer surface when the outer surface reaches the uncompressed state, the second one-way valve providing a passageway for air to replenish the pump pressure cavity.

* * * * *